US005495870A

United States Patent [19]

Dorta

[11] Patent Number: 5,495,870

[45] Date of Patent: Mar. 5, 1996

[54] COMBINATION TOY AND BEVERAGE DISPENSING DEVICE

[76] Inventor: Juan F. Dorta, 2902 S. Western Ave., Los Angeles, Calif. 90018

[21] Appl. No.: 178,738

[22] Filed: Jan. 6, 1994

Related U.S. Application Data

[63] Continuation-in-part of Ser. No. 812,414, Dec. 23, 1991, Pat. No. 5,277,642.

[51] Int. Cl.[6] ..... F16K 24/00; F16K 31/44; A47G 19/22

[52] U.S. Cl. ..... 137/588; 251/250; 251/353; 251/9; 220/705

[58] Field of Search ..... 251/250, 7, 9, 251/353, 354; 137/587, 588; 220/705

[56] References Cited

U.S. PATENT DOCUMENTS

| | | | |
|---|---|---|---|
| 3,329,390 | 7/1967 | Hulsey | 251/250 |
| 3,540,402 | 11/1970 | Kocker | 251/353 |
| 4,059,113 | 11/1977 | Beinsen et al. | 137/241 |
| 4,269,333 | 5/1981 | Nakai et al. | 251/9 |
| 5,277,642 | 1/1994 | Dorta | 222/538 |

*Primary Examiner*—A. Michael Chambers
*Attorney, Agent, or Firm*—Robert J. Schaap

[57] ABSTRACT

A combination toy and beverage dispensing device, primarily adapted for use with children and particularly minor children who are still consuming liquids from a bottle and similar dispensing device. The dispensing device has an outer housing which adopts the form of a ball and with which a toddler can play and use in a playpen or like confined area. The housing of the ball includes an interior chamber capable of retaining a beverage or other liquid, such as milk, to be dispensed through a valve arrangement. The valve arrangement has an actuating mechanism with an outer surface generally conforming to the surface of the ball housing. When the actuating member is pushed against, as, for example, by the lips of the child user, it will cause an extension or outward extending movement of a stem. The stem contains a liquid delivery tube and an air supply tube which both extend into the beverage in the interior chamber. When the actuating member is not pushed against, and in a rest position, the air supply tube and the liquid delivery tube are both blocked. However, when the child user pushes against the actuating member to engage his or her lips upon the stem, the pushing of the actuating member will also open the liquid delivery tube and the air supply tube, thereby enabling a delivery of the beverage to the child user.

20 Claims, 9 Drawing Sheets

COMBINATION TOY AND BEVERAGE DISPENSING DEVICE

RELATED APPLICATION

This application is a continuation-in-part of my U.S. patent application Ser. No. 812,414, filed Dec. 23, 1991 for "Combination Toy and Beverage Dispensing Device now U.S. Pat. No. 5,271,642."

BACKGROUND OF THE INVENTION

1. Field of the Invention

This invention relates in general to combination toy and beverage dispensing devices and more particularly to toy and beverage dispensing device combinations which are constructed so that a child user may play with the toy and may also actuate the device for purposes of withdrawing a liquid beverage therefrom.

2. Brief Description of the Prior Art

In many cases, children, and particularly toddlers, who are necessarily confined to playpens and like areas become restless and require some stimulation as, for example, with play toys or the like. Furthermore, relatively infant children require bottles for feeding and particularly, bottles of milk or similar beverage. When the baby is finished with the bottle, he or she may resort to crying in order to have his or her needs met. Very often, it remains for the mother or other attendant to merely provide a toy in place of the bottle.

Heretofore, there has not been any effective toy and beverage dispensing combination in which the toy can function as a ball for purposes of play and also as a beverage dispensing device so that the child user can extract a beverage therefrom. There has been a need for a ball that can be used as a play item, particularly for children under four years of age. This ball must be capable of being utilized as a mechanism for feeding the child as well and which necessarily must be safe and easy to operate. Further, there has been a need for a device of this type in which there is no danger of spilling liquid when the ball is located in a playpen or similar confined area.

There have been numerous beverage dispensing bottles such as milk bottles in the prior art and which are typically of an elongate shape containing a nipple at the end for the child user to engage and draw liquid from the bottle by a sucking action. In many cases, there have been liners which are proposed for use in these baby bottles and which liners contain the milk or other liquid to be dispensed. However, beyond this, there has not been any effective combination of toy and liquid dispensing mechanism which will truly operate as a toy such as a ball and will also effectively serve as a liquid dispensing mechanism.

There has been one rather rudimentary liquid toy feeder device shown in U.S. Pat. No. 4,930,645, dated Jun. 5, 1990 to Warchime. This device generally comprises a housing having a spherical form with a conventional nipple mounted within the housing to withdraw beverage from the housing. The nipple may be extended into the housing when not in use. However, there is nothing to preclude spilling of the liquid when the device is used as a toy. Moreover, there is no means for introducing air into the beverage chamber to equalize pressure when beverage is withdrawn therefrom.

In my co-pending U.S. patent application Ser. No. 812, 414, filed Dec. 23, 1991, there is disclosed a combination toy and beverage dispensing device which is highly effective for its intended purpose. However, here has also been a need for a similar device having much simplified and less expensive type of construction. The present invention thereby obviates all of the provisions of the prior art and provides an improved combination toy and beverage dispensing device.

OBJECTS OF THE INVENTION

It is, therefore, one of the primary objects of the present invention to provide a combination toy and beverage dispensing device which is capable of being used as a toy by a relatively minor child and which can also be easily actuated by a child user for purposes of extracting a liquid beverage contained therein.

It is another object of the present invention to provide a combination toy and beverage dispensing device of the type stated in which the toy may adopt the form of a ball and which ball contains an inner container which is provided with a dispensable liquid beverage.

It is a further object of the present invention to provide a combination toy and beverage dispensing device of the type stated which is readily useable by small children and including children of toddler ages and which can also be used as a play toy even after the child has outgrown the need for drinking from a bottle.

It is an additional object of the present invention to provide a combination toy and beverage dispensing device of the type stated in which there is no possibility of liquid spillage when the child user attempts to use the toy as a toy.

It is another salient object of the present invention to provide a combination toy and beverage dispensing device of the type stated which is quite safe to use and which can be manufactured at a relatively low cost.

It is still another object of the present invention to provide a combination toy and beverage dispensing device of the type stated which can be easily disassembled for repair and cleaning and rapidly and easily re-assembled for use thereof.

With the above and other objects in view, my invention resides in the novel features of form, construction, arrangement and combination of parts presently described and pointed out in the claims.

BRIEF SUMMARY OF THE DISCLOSURE

The present invention relates in general terms to a combination beverage dispensing device or so-called drinking bottle and toy playing device such as a playing ball. The device comprises an outer housing or shell of a relatively hard plastic material for housing a beverage dispensing container. The outer shell may be covered by a foam plastic to provide a soft surface playing ball and an outer protective relatively soft cover therefor.

The novel toy-beverage dispensing device includes the outer housing with an inner liner adapted to form an interior chamber holding a beverage capable of being dispensed. This liner may be of a somewhat flexible and yieldable material, but is provided with a somewhat more rigid neck capable of receiving a valve assembly. In the present embodiment of the invention, the valve assembly can be constructed as a unitary unit which is capable of being removed directly from the housing for purposes of cleaning and the like.

The valve assembly of the invention has an outer valve casing comprised of a inner section and an outer section and the outer section of which is telescopically arranged with respect to the inner section. A stem means forms part of this valve assembly and has an end which is capable of extending outwardly from the spherically shaped housing for engagement by the lips of a child user.

A liquid delivery tube extends through the valve casing and has an end located in the beverage container for withdrawing the beverage and enabling a dispensing of the same. An air supply tube also extends through the valve casing and particularly, the stem means and has an end also located in the beverage containing chamber. The air supply tube has a second end in communication with the external atmosphere to thereby equalize the pressure in the chamber when a beverage is withdrawn therefrom.

The valve arrangement includes an actuable means associated with the stem means. This actuable means causes a blocking of the liquid delivery tube and also the air supply tube when the valve assembly is unactuated, that is, when it is not engaged by the lips of a child user. However, the valve assembly is actuated when a child user engages his or her lips against an outer surface of this valve assembly and pushes the actuating member inwardly into the housing. The pushing of this actuating member releases and opens the liquid delivery tube and the air supply tube.

When liquid delivery tube and the air supply tube are being opened, the stem means is extended outwardly of the housing simultaneously therewith. In this way, the child user can engage the stem and suck on the stem. Liquid will also be able to flow from the interior beverage chamber through the liquid delivery tube and into the mouth of the user. Further, air will also be able to be introduced into the beverage chamber for equalizing the pressure therein.

The outer surface of the actuable means actually functions as a type of plug. Nevertheless, it has a surface which essentially conforms to the surface of the outer housing, as previously described.

A crimping means is employed in the device of the invention to literally crimp the flexible liquid delivery tube and the air supply tube. This crimping means is operated by the actuating mechanism when the latter is pushed on by the lips of a child user. In this way, the device is essentially fail-safe in that there will be no delivery of beverage and further, there will be no leakage of milk or other beverage when the device is used as a toy.

The actuable means comprises a rack section which is operable when the user's lips engages the actuable means and pushes inwardly on the same. This rack mechanism operates in conjunction with the stem means and the crimping means, as previously described. Thus, the rack arrangement causes an extension of the stem means and also causes a release of the crimping means.

The beverage delivery tube also has an inner end which is of a flexible construction and the inner end thereof is weighted so that the inner end of the tube is always located within a beverage in the container, regardless of the orientation of the container.

A bellows can be located in the air tube and this bellows can operate as a type of pumping means in a manner to be hereinafter described in more detail. However, when operated as a pumping means, air will be introduced into the beverage dispensing container thereby aiding in the delivery of the beverage through the beverage delivery tube to the mouth of the child user. If the air pressure is sufficient, it will force the liquid directly to the mouth of the child user and if not, it can be implemented by sucking action of the child user.

The outer end of the stem means itself is normally located within the housing and does not project appreciably beyond the housing surface, if at all, when the device is used as a playing toy. Thus, in the preferred embodiment of the invention, when the device adopts the form of a ball, the beverage delivery tube is located so that the outer end thereof does not project beyond the surface of the ball.

The combination of the plug and the bellows, along with the air tube and the beverage delivery tube, operate as a type of actuating means. Thus, when the plug is pushed inwardly, the child user actually actuates the beverage delivery system by causing a pressure build-up in the beverage dispensing container as a result of the contraction of the bellows. This pressure build-up starts the release and delivery of the beverage in the manner previously described. In like manner, when the child releases the pressure against the plug, the plug will shift outwardly causing the stem to be retracted inwardly within the housing and thereby stop the flow of beverage through the beverage delivery tube. In addition, since the outer end of the beverage delivery tube is retracted within the housing, the device can then be used as a playing ball or other type of toy.

The housing itself may also be weighted so that it will roll in the same manner as a ball, regardless of the orientation of the ball. The beverage dispensing mechanism itself creates some added weight and also shifts the normal center of gravity of the ball. As a result, the ball would be weighted along one side. The additional weight in the outer shell to offset this additional weight of the beverage dispensing mechanism enables the ball to truly roll as a ball.

This invention possesses many other advantages and has other purposes which may be made more clearly apparent from a consideration of the forms in which it may be embodied. These forms are shown in the drawings forming a part of and accompanying the present specification. They will now be described in detail in the following detailed description of this invention for the purposes of setting forth the general principals of the invention. However, it is to be understood that the accompanying drawings and the following detailed description is not to be taken in a limiting sense.

BRIEF DESCRIPTION OF THE DRAWINGS

Figure 1:
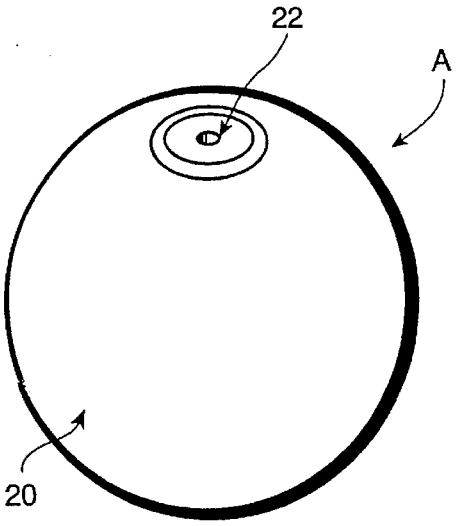
Figure 2:
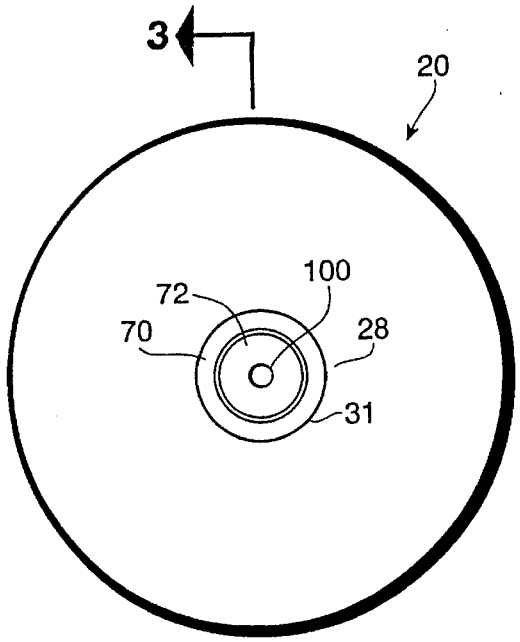
Figure 3:
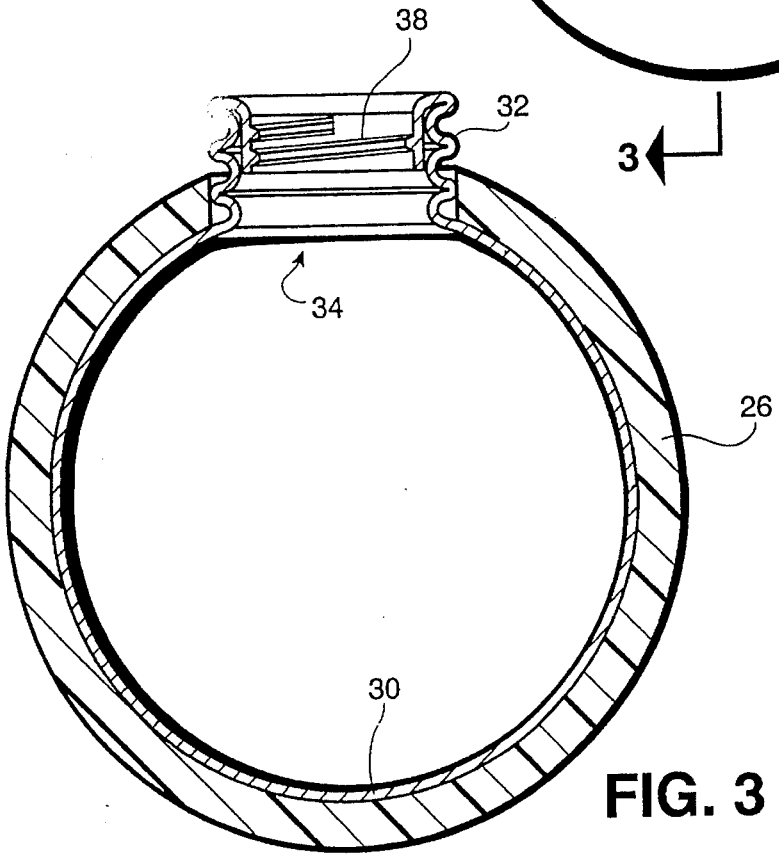
Figure 4:
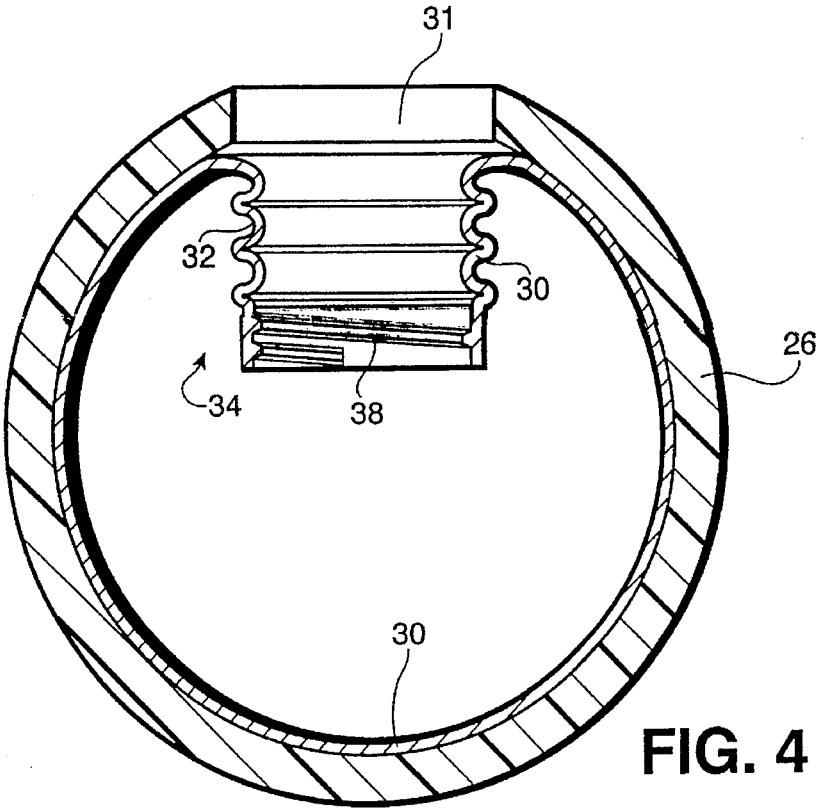
Figure 5:
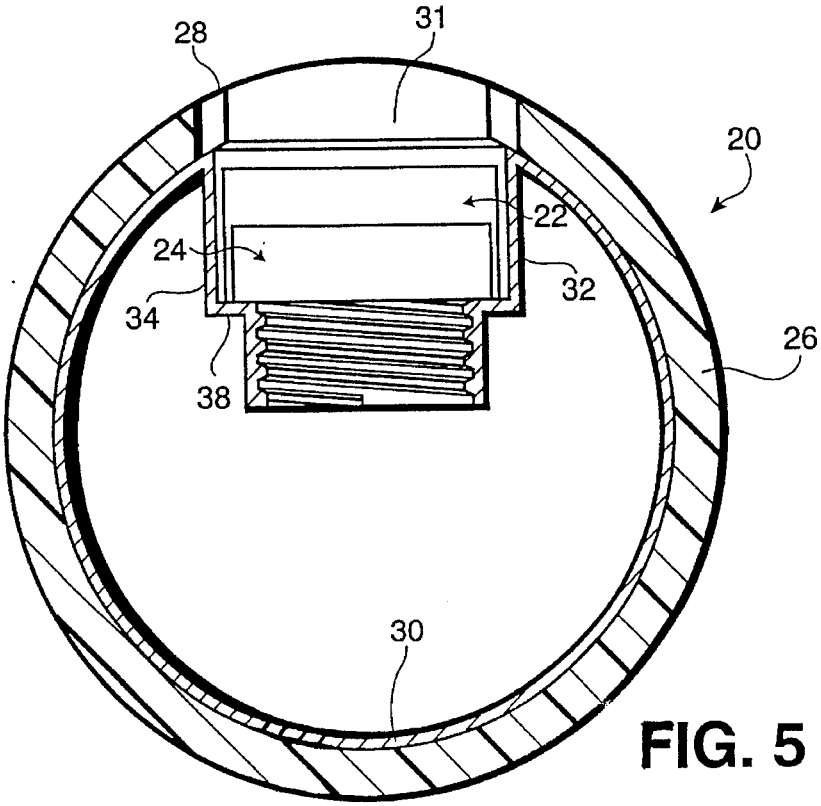
Figure 7:
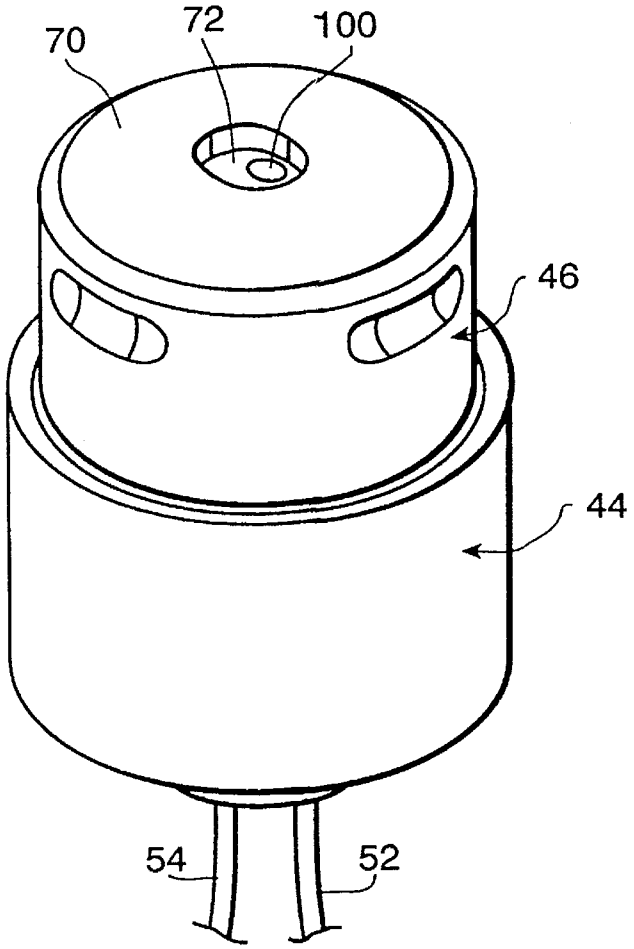
Figure 6:
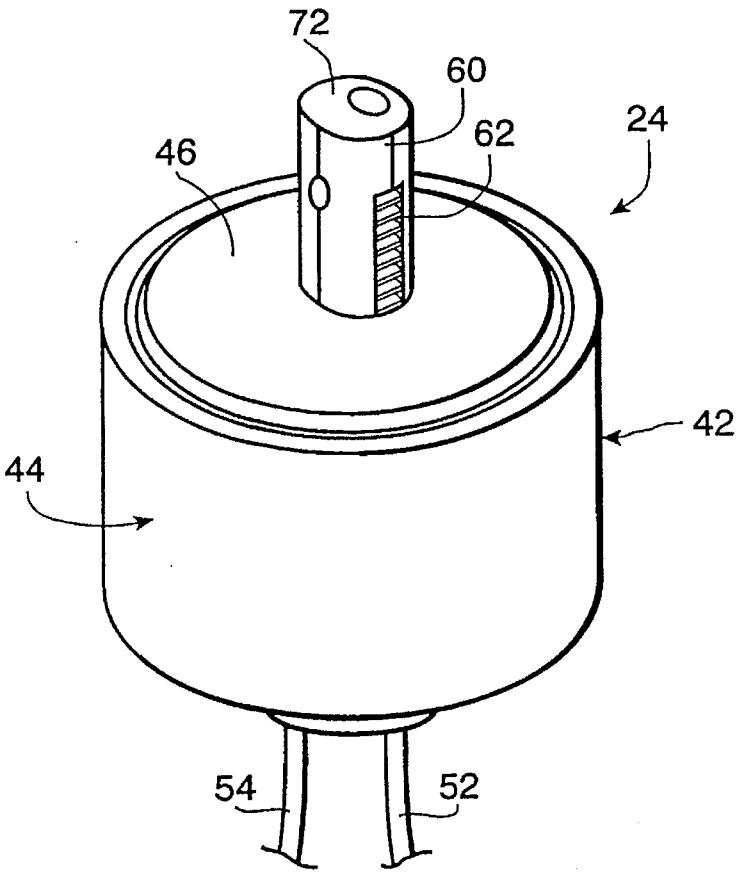
Figure 8:
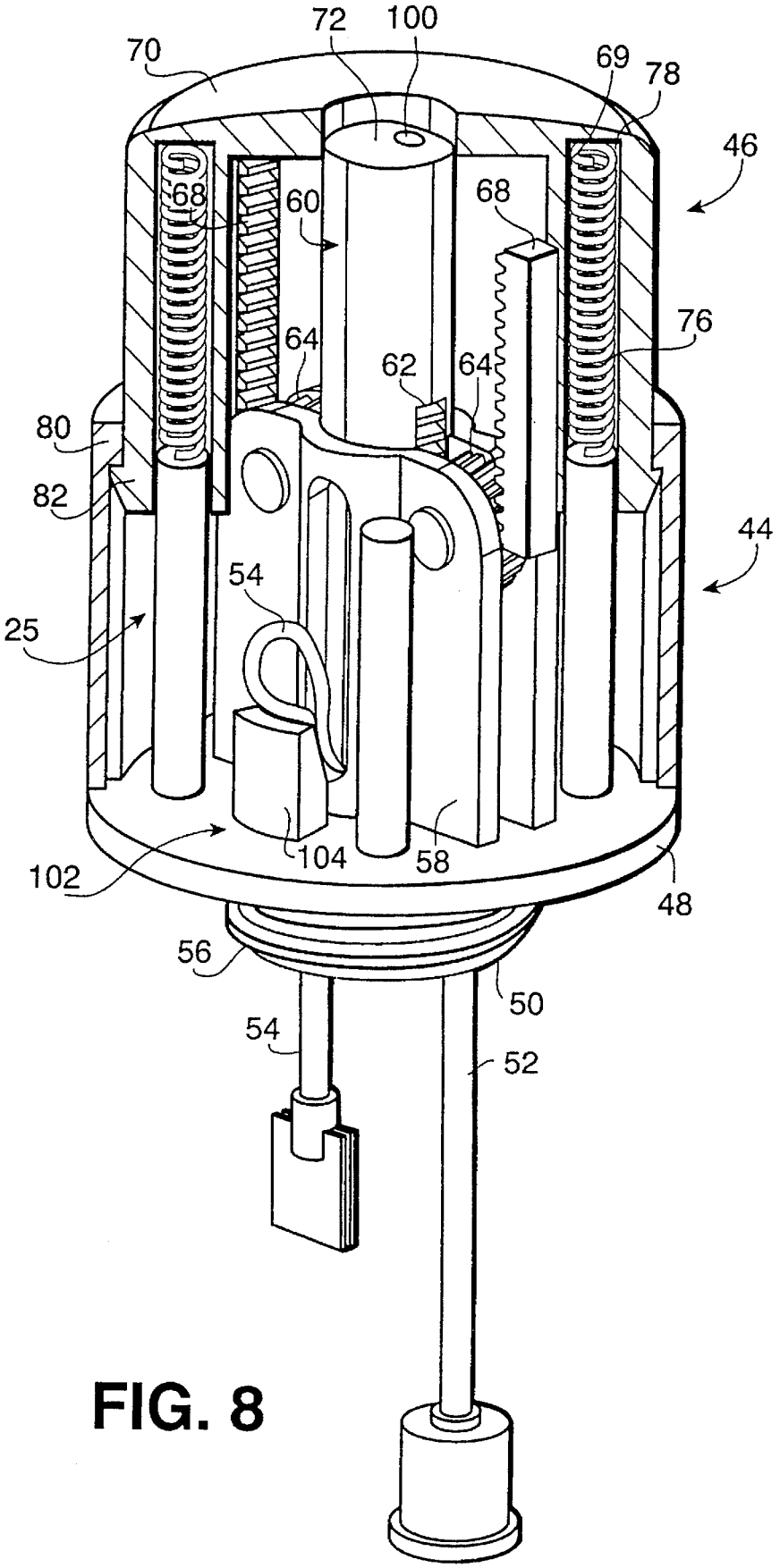
Figure 9:
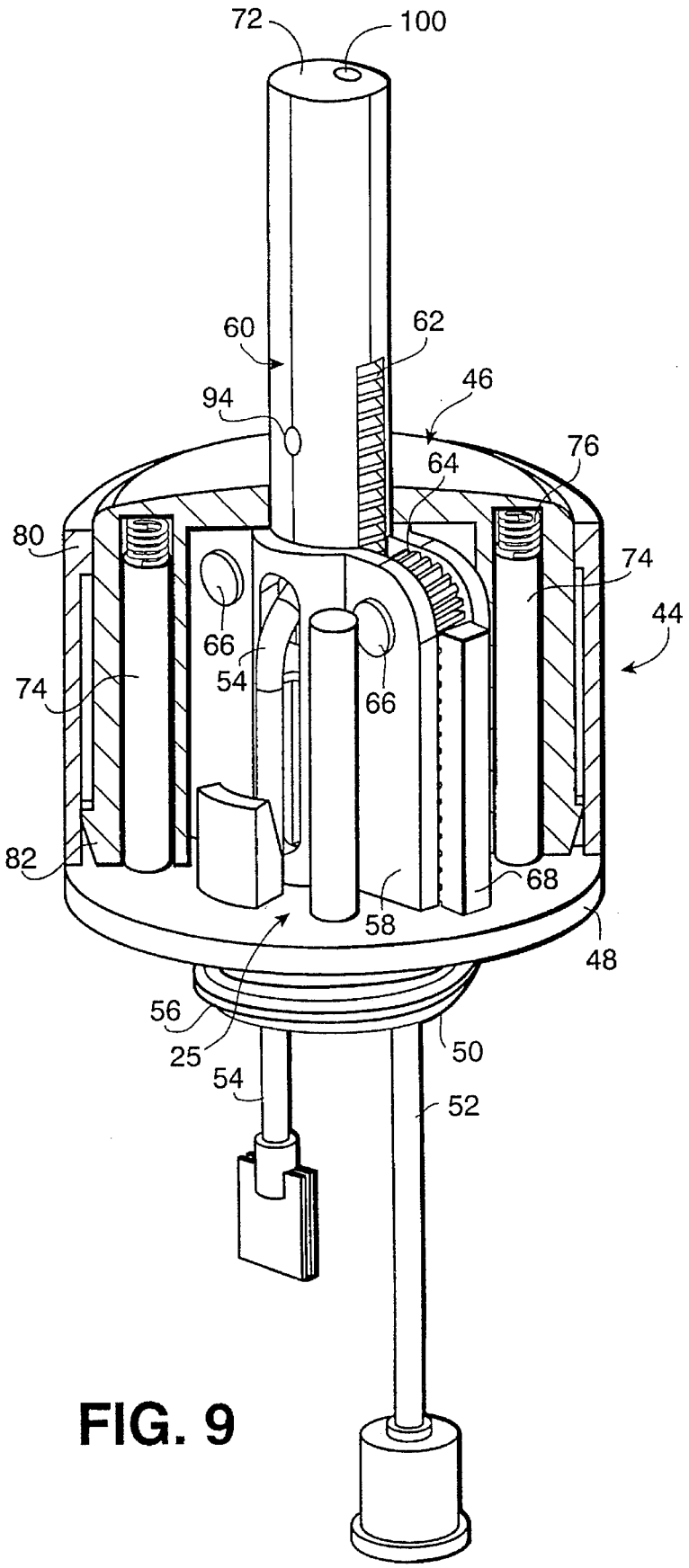
Figure 10:
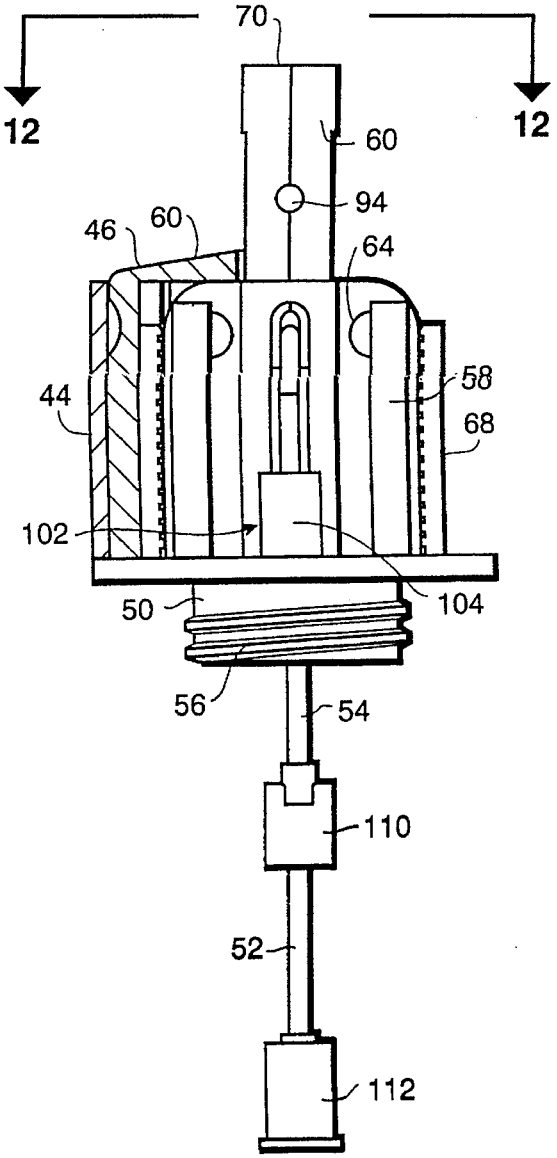
Figure 11:
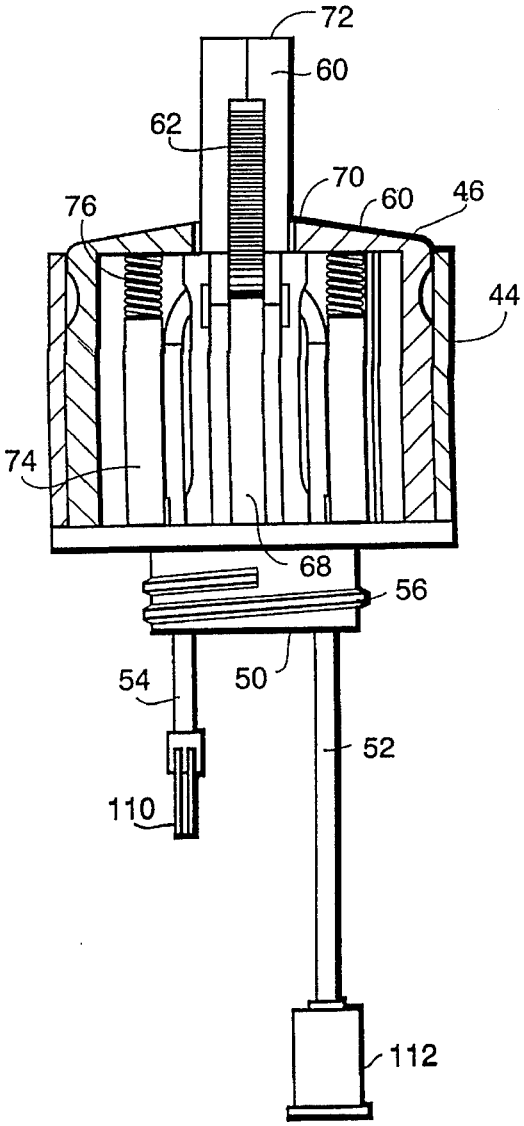
Figure 12:
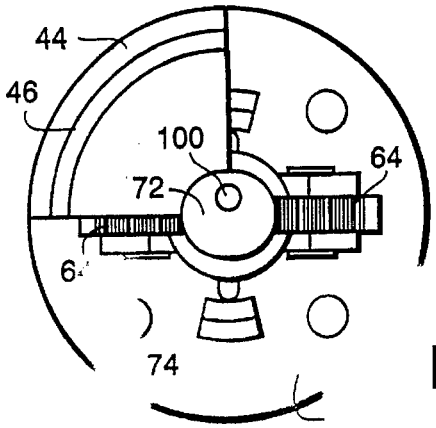
Figure 13:
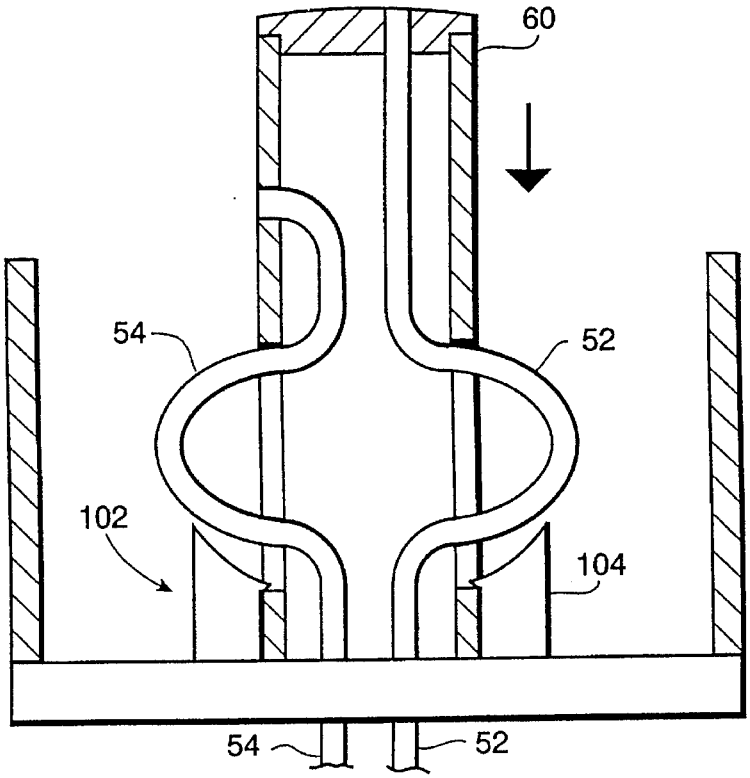
Figure 14:
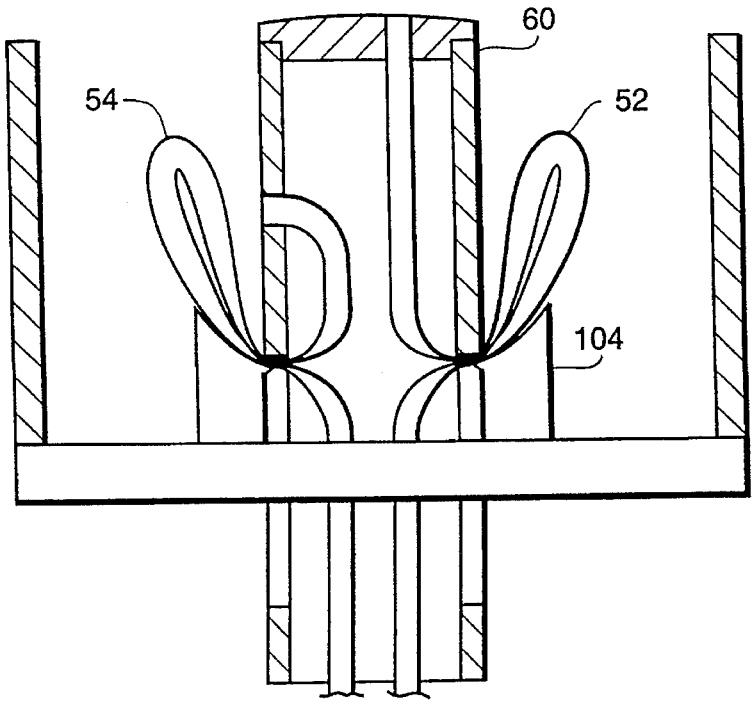
Figure 15:
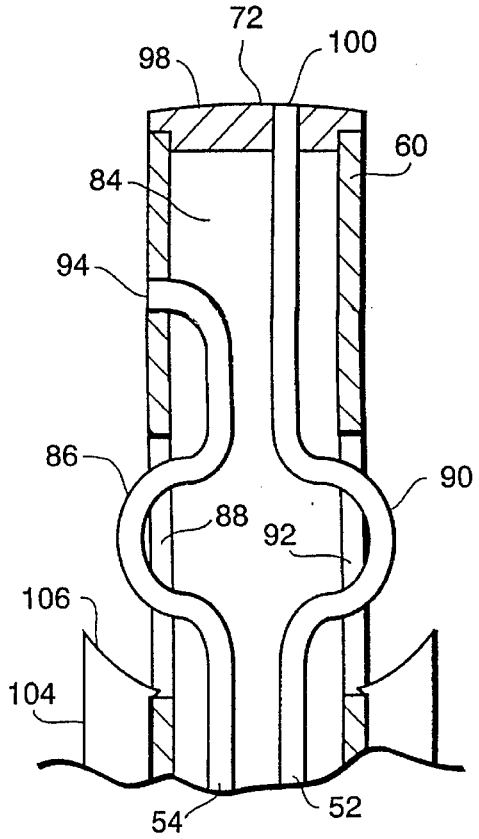
Figure 16:
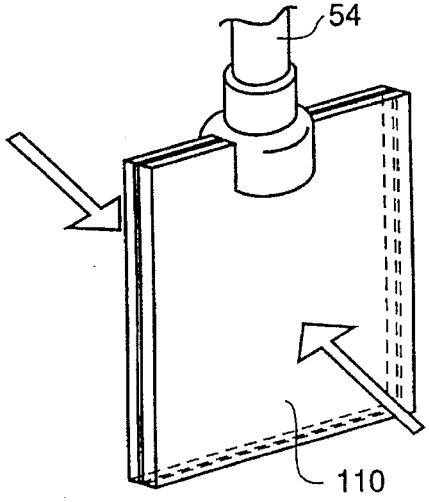
Figure 17:
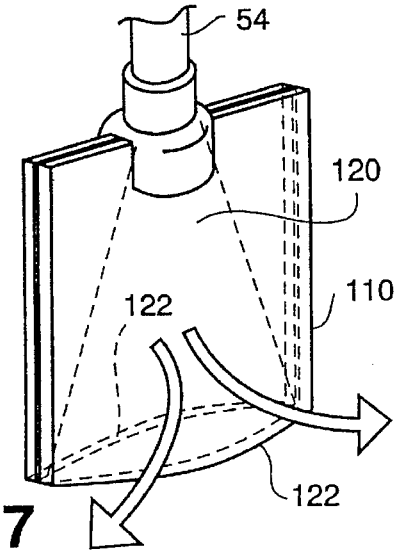
Figure 18:
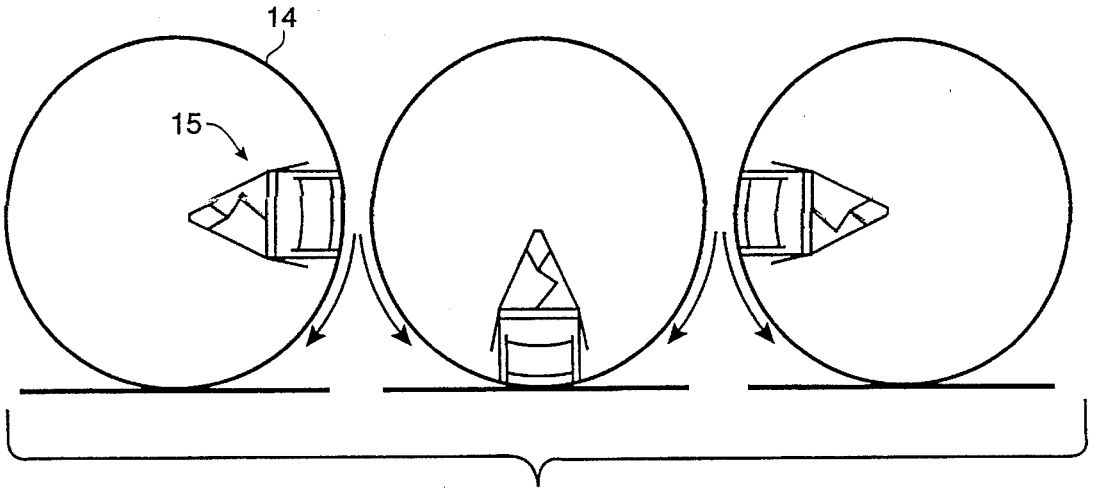
Figure 19:
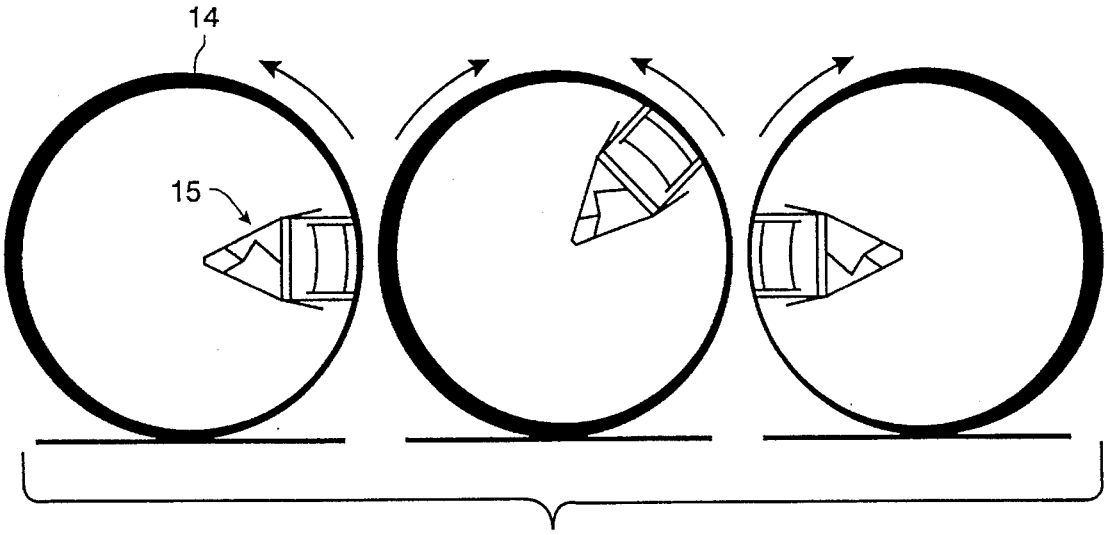

Having thus described the invention in general terms, reference will now be made to the accompanying drawings in which:

FIG. 1 is a perspective view of a combination toy and beverage dispensing device constructed in accordance with and embodying the present invention;

FIG. 2 is a top plan view of the combination toy and beverage dispensing device of FIG. 1;

FIG. 3 is a vertical sectional view of the beverage dispensing device, taken along line 3—3 of FIG. 2 and showing an interior portion of the outer housing and liner forming a part thereof;

FIG. 4 is a vertical sectional view, similar to FIG. 3 and showing a valve supporting cup forming part of the liner located within the outer housing;

FIG. 5 is a vertical sectional view, similar to FIG. 4, and showing a valve mechanism retained in the valve supporting cup;

FIG. 6 is a perspective view of a valve arrangement which is used in the beverage dispensing device of the present invention;

FIG. 7 is a perspective view of the valve arrangement of FIG. 6 and showing the same an unactuated position;

FIG. 8 is a perspective view, partially broken away and in section, and showing a portion of the valve arrangement used in the beverage dispensing device of the present invention while in an unactuated condition;

FIG. 9 is a perspective view, also partially broken away and in section, of the valve arrangement of FIG. 8 and showing the valve arrangement in an actuated condition;

FIG. 10 is a side elevational view, partially broken away and in section, of the valve arrangement corresponding to FIG. 8, when the valve arrangement is in an actuated position;

FIG. 11 is an opposite side elevational view of the valve arrangement corresponding to FIG. 8, when the valve arrangement is also in an actuated condition;

FIG. 12 is a top plan view, partially broken away and taken essentially along the plane of line 12—12 of FIG. 10;

FIG. 13 is a somewhat schematic view showing a crimping mechanism forming part of the valve arrangement in the present invention when the latter is unactuated;

FIG. 14 is a somewhat schematic elevational view of the crimping mechanism forming part of the valve arrangement when the valve arrangement is in the unactuated condition;

FIG. 15 is a fragmentary vertical sectional view showing the interior of the stem and an air supply tube and liquid delivery tube extending therethrough;

FIG. 16 is a perspective view of an air-pervious liquid-impervious plate in a position where it is precluding liquid flow therethrough and which forms part of the air supply mechanism of the present invention;

FIG. 17 is a perspective view, similar to FIG. 16, but showing an exit of air through the plate of FIG. 16;

FIG. 18 is a series of three composite schematic views showing the tendency for a combination toy and beverage dispensing device, in the nature of a ball, to assume one specific rest position if not properly weighted; and FIG. 19 is a series of three composite schematic views somewhat similar to FIG. 18, and showing a free rotation of a toy playing ball when weighted properly in accordance with the present invention.

DETAILED DESCRIPTION OF A PREFERRED EMBODIMENT

Referring now in more detail and by reference characters to the drawings which illustrate a preferred embodiment of the present invention, A designates a combination toy and beverage dispensing device which is preferably in the form of a round spherical ball as best illustrated in FIG. 1 of the drawings. In this case, it should be understood that a ball is the preferred form of toy which may be constructed with this invention, although the ball could adopt an outer housing in numerous other shapes so as to be used as other forms of playing toys.

The combination toy beverage dispensing device A, in the preferred embodiment, includes as the major components thereof, a playing ball housing 20 in the manner as previously described and a beverage dispensing mechanism 22. The beverage dispensing mechanism 22 is actually in the nature of a valve arrangement 24, as best illustrated in FIGS. 6–15 of the drawings.

The playing ball housing 20 comprises an outer shell 26 which may be generally spherical in shape, as best illustrated in FIGS. 2–5 of the drawings. However, the housing has one small flat portion 28 along the surface thereof to receive the valve arrangement 24, as hereinafter described. The housing may be provided, in a preferred embodiment, with a relatively soft outer covering (not shown) which extends about the outer shell. This outer covering may be a sponge-like soft covering or the like. Nevertheless, the outer shell does provide a somewhat structural housing for the ball.

Located within the housing 20 is a beverage dispensing liner 30 which functions as a beverage dispensing container. This liner may preferably be of a somewhat flexible and foldable plastic sheet material, so as to be capable of being removed through an opening 31 located at the flat portion 28 of the outer housing 20.

The inner liner 30 is also provided with a neck 32 forming part of a valve supporting cup 34 which is more fully illustrated in FIGS. 3 and 4 of the drawings. The valve supporting cup 34 is designed to retain the valve mechanism 24, as best illustrated in FIG. 5 of the drawings. The neck 32 is formed of a somewhat thicker walled plastic material which may be integral with the liner 30. However, the valve supporting cap 34 formed with the neck 32 is still sufficiently flexible to be able to be pulled upwardly and outwardly of the housing, as shown in FIG. 3 and to be pushed back into the housing to assume the valve supporting position, as best illustrated in FIG. 4.

The neck 32 is provided with an internally threaded section 36 which is integrally formed in the neck itself. In effect large threads form this threaded section 36 in order to receive and hold the valve mechanism in a manner to be hereinafter described. The neck 32 of the valve supporting cup 34 also includes a supporting bottom wall 38, but which is partially opened to allow tubes (hereinafter described) to extend therethrough and into a beverage contained within the liner 30.

The valve supporting cup 34 may be pulled outwardly, in the manner as illustrated in FIG. 3, in order to pull the entire inner liner 30 from the housing shell 26. In this way, the interior of the liner can be washed, or otherwise cleansed. Moreover, the pulling of the neck 30 into the position as shown in FIG. 3 also allows the neck to serve as a spout and thereby enable the filling of the liner 34 with a suitable beverage, such as milk or the like.

When the liner is pushed back into the valve receiving position, as shown in FIG. 4, the valve mechanism 24 may be located therein, as best illustrated in FIG. 5 of the drawings. The valve mechanism has a plug hereinafter described which literally covers the opened end 31 of the housing 20.

The valve mechanism 24 is often referred to as a valve mechanism, as such, inasmuch as it does control the flow of beverage from the beverage dispensing chamber to the child user. However, the valve mechanism 24 is not a true valve, in that it opens and closes in the same manner as a normal valve, such as a gate valve, check valve or the like. The valve mechanism 24 further includes as an actuating mechanism which controls fluid flow and air flow, as hereinafter described. In this sense, the actuating mechanism causes a hereinafter described stem means to extend outwardly of the housing for engagement by the lips of a child user and to cause an opening and closing of a beverage tube, also hereinafter described in more detail.

The valve arrangement, comprises a casing 42 having an outer casing section 44 and an inner casing section 46, as best illustrated in FIGS. 6 and 7 of the drawings. The inner casing section 46 is telescopically extendable with respect to the casing section 44, as shown in FIG. 7.

The valve casing 42 and hence, the casing sections 44 and 46 are cylindrical in shape, as best illustrated in FIGS. 6 and 7 of the drawings. Moreover, the valve casing 42 is sized to fit within the threaded section 36 of the neck 32 and to be retentively held therein. Nevertheless, the valve casing 42 can be removed therefrom. For this purpose, the outer casing 44 would normally be provided with an externally threaded section (not shown) for securement with the internally threaded section 36 of the neck 30.

The internal components of the valve arrangement, that is the components in the casing 42, constitute an actuating mechanism 25 which is best illustrated in FIGS. 8–15 of the drawings. The outer casing section 44, which is often referred to as the "second" casing section, is provided with a bottom wall 48, which functions as a lower support plate, as best shown in FIGS. 8 and 9. Mounted on the undersurface of the bottom wall 48 is a cylindrically shaped hub 50 for supporting a liquid delivery tube 52 and an air supply tube 54, which are also hereinafter described in more detail. The hub 50 may be provided on its annular surface with a threaded section 56, as shown, in the event that it is desired to have the actuating mechanism extend beyond the surface of the housing 20. However, in the preferred form of construction, the exterior surface of the casing section 44 is provided with the threaded section for mounting within the neck of the inner liner 30.

Mounted on the upper surface of the support plate 48 is a frame 58, as best shown in FIGS. 8 and 9 of the drawings. This frame 58 supports a stem means, or so-called "stem" 60, as also hereinafter described in more detail. The stem 60 is provided with a pair of rack segments 62 on each of its opposite sides and which are disposed in meshing engagement with gears 64, the latter of which are retained by pivot pins 66, extending through the frame 58. Furthermore, it can be observed that the gears 64, which may be in the form of conventional pinion gears, are also disposed in meshing engagement with vertically shiftable rack segments 68 mounted on and secured to depending cylindrically shaped flanges 69 on the interior of the casing section 46, as best illustrated in FIGS. 8 and 9 of the drawings.

It can be observed in accordance with the above-outlined construction that when the inner casing section 46 is pushed inwardly (downwardly with reference to FIG. 8), it will simultaneously shift the rack segments 68 downwardly. Movement of the rack segment 68 will cause a rotation of the pinion gears 64 about the pivot pins 66. This will, in turn, cause an extendable shifting movement of the stem means 60 outwardly with respect to the outer casing 42. In like manner, when the inner casing section 46 is permitted to raise relative to the outer casing section 44, as shown in FIG. 6, the rack segments 68 will simultaneously be raised causing a concomitant lowering or retraction of the stem means 60 to the position as shown in FIG. 8 of the drawings.

The inner housing section 46 actually functions as a type of plug and is frequently referred to herein as a "plug." The housing section 46 also has an upper surface 70 which is adapted to essentially conform to the spherical surface of the housing 20 in a preferred embodiment. Otherwise, it is preferably provided with a somewhat flat surface, but with no sharp edges so that it does not present any danger to a child user. In like manner, the stem means 60 is provided with an upper cap 72, as best shown, and which also terminates at the surface of the casing section 46 when the casing section is in the unactuated position, as shown in FIG. 8.

In a preferred embodiment, the upper cap 72 of the stem means 60 may terminate slightly below the upper surface 70 of the casing section 46, as shown in FIGS. 7 and 8 of the drawings.

Also mounted on the upper surface of the supporting plate 48 are a pair of upstanding posts 74 which suitably support coiled springs 76 located within a spring-retaining chamber 78 formed by the outer wall of the casing section 46 and the inner flanges 69.

The compression springs 76 will bear against the undersurface of the top wall 70 of the plug or second housing section 46 and bias the same upwardly to the unactuated position, as shown in FIG. 8. The compression springs 76 have been partially broken away in order to more fully illustrate the construction, as shown in FIGS. 7 and 8, although in a preferred embodiment they would contact the underside of the top wall 70. In this way, when a child user pushes against the upper surface 70 of the plug 46, the child user will push against the action of the compression springs 76. When the pressure is released, the compression springs 76 will automatically cause the housing section or plug 46 to shift outwardly. Furthermore, the outer housing section 44 is provided with a hook 80 which engages a like hook 82 on the lower end of the plug 46, as shown in FIGS. 8 and 9.

By reference to FIG. 15, it can be seen that the air supply tube 54 and the liquid delivery tube 52 both extend through the stem 60 which is of a hollow tubular construction and are located within a central bore 84 of the stem 60. The air supply tube 54 has a outwardly struck loop 86 extending outwardly from the stem 60 through an elongate slot 88 formed in the annular side wall of the stem 60. In like manner, the liquid delivery tube 52 has an outwardly struck loop 90 which extends outwardly of the stem 60 through an elongate slot 92 formed in the annular side wall of the stem, all as best shown in FIG. 15 of the drawings.

The air supply tube terminates at a vent opening 94 in the annular side wall of the stem 60, as also best illustrated in FIG. 15. However, the liquid delivery tube 52 terminates at the cap 72 closing the upper end of the stem 60 with an outer surface 98. The tube 52 communicates with the external atmosphere through a liquid delivery opening 100. Thus, and in accordance with this construction, if the child user of the device puts his lips around the stem 60, the beverage in the container will be dispensed through the liquid delivery tube 90 and the discharge opening 100 into the mouth of the child user.

The actuating mechanism 25 also includes a crimping mechanism 102 which is also best illustrated in FIGS. 8, 9 and 15 of the drawings. The crimping mechanism 102 comprises a pair of crimping blocks 104 on the upper surface of the plate 48 and on opposite sides of the stem 60. The crimping blocks 104 have upper arcuate surfaces 106 which extend to the respective elongate slots 88 and 92, as shown in FIG. 15. In accordance with this construction, it can be observed that as the stem 60 is lowered to the position as illustrated in FIG. 8, the stem 60 will cooperate with the upper surfaces 106 of the crimping blocks 104 and literally crimp the air supply tube 54 and the liquid delivery tube 52, as also shown in FIG. 14 of the drawings. In this way, when the plug or casing section 46 is allowed to raise to the extended position, as shown in FIGS. 7 and 8, the stem 60 will be retracted within the casing 44. As this occurs, a crimping action will occur in the tubes 52 and 54, thereby precluding any communication between the interior beverage containing chamber and the external atmosphere. In like manner, when the user of the device pushes downwardly on the cap 46, the stem 60 will also be extended, thereby allowing fluid communication in the tubes 52 and 54, as shown in FIGS. 13 and 15.

The lower end of the air supply tube 54 is provided with a plate 110 which is air-pervious, but liquid impervious. This plate 110 permits the passage of air therethrough, but does not permit the passage of a liquid, such as water. In this case, air is allowed to enter into the beverage-containing chamber in order to equalize pressure. The plate 110 is may actually exist in the form of a bag of the type used to permit air flow therethrough, but which precludes any liquid flow. Bags of this type are commonly used in hospital environments for collection of urine. These bags are connected through tubing through the urethra and allow for the collection of urine, but permit passage of air. The same material is used in the present invention in the formation of this type of bag or plate.

By reference to FIG. 17, it can be seen that the bag contains a pocket 120 in which air is delivered through the air supply tube 54. The air will pass through walls 122 forming the pocket, as shown by the arrows in FIG. 17. However, when referring to FIG. 16, the arrows show the pressure of the liquid, such as the milk or other beverage. In this case, the material does not permit the flow of liquid.

The lower end of the liquid delivery tube 52 is provided with a weighted end 112, as also best shown in FIGS. 10 and 11 of the drawings. In this case, the lower end of the liquid delivery tube 52 will drop with the force of gravity. Thus, the lower end of the liquid delivery tube 52 will always be located in a beverage contained within the liner 30, regardless of the orientation of the device, and thus regardless of the orientation of the beverage dispensing chamber itself.

If desired, a type of check valve can be inserted in the air supply tube 54 in order to preclude a withdrawal of air from the beverage chamber. Any form of conventional check valve could be employed for this purpose and therefore, no particular valve is illustrated or described herein.

As indicated previously, the entire beverage dispensing mechanism, which includes essentially those components illustrated in FIGS. 5–17 of the drawings, is mounted on one side of the playing ball housing. Thus, the center of gravity of the ball would be offset from the true axial and diametrical center of the ball. As a result, the ball would roll in such manner that the heavily weighted portion of the beverage dispensing mechanism thereof would rest when it achieved a lower-most position. FIG. 18 of the drawings illustrate the beverage dispensing mechanism on opposite sides of the ball in two exterior views. The interior or middle view of FIG. 18 clearly show how the ball would come to rest with the beverage dispensing mechanism mounted at one side of the ball.

In order to obviate and overcome this problem and to enable a rolling movement of an unbalanced ball, the outer shell is provided with a greater thickness of material and hence, greater weight, on the side opposite to the beverage dispensing mechanism. In this case, it can be observed that the outer shell progressively increases in thickness slightly along the circumference thereof in proportion to the distance away from the liquid dispensing mechanism. The portion of the shell diameterally opposite the dispensing mechanism would have the greatest thickness as illustrated in FIG. 19. Thus, it can be observed in accordance with FIG. 19 that the ball will freely rotate as though it were evenly weighted along all portions of the angular surface thereof.

Thus, there has been illustrated and described a unique and novel combination toy and beverage dispensing device which permits play with the toy by a child user and also which permits dispensing of a beverage contained therein. The device of the present invention therefore, fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by letters patent is:

1. A valve mechanism for dispensing a liquid from a generally enclosed chamber, said valve mechanism comprising:

a) a supporting frame;

b) a liquid delivery tube extending from said supporting frame and having an end located in the liquid for withdrawing the liquid and enabling dispensing of same;

c) an air supply tube extending from said frame and having an end located in said generally enclosed chamber and an end in communication with an external atmosphere to equalize pressure in the chamber when liquid is withdrawn therefrom;

d) a reciprocally shiftable stem means associated with said frame and extending outwardly therefrom, said liquid delivery tube extending through said stem means such that an end of the stem means can be engaged by the lips of a user to withdraw liquid dispensed through the liquid delivery tube extending axially through the stem means; and e) actuable means associated with the stem means and being actuated when the stem means is reciprocally shifted thereby causing a blocking of the liquid delivery tube when the actuable means is unactuated, but causing an opening of the liquid delivery tube when the actuable means is engaged by a user and pushed against to be actuated and thereby enabling a withdrawal of liquid.

2. The valve mechanism for dispensing a liquid of claim 1 further characterized in that said actuable means also causes a blocking of the air supply tube when the actuable means is unactuated and an opening of the air supply tube when the actuable means is actuated.

3. The valve mechanism for dispensing a liquid of claim 2 further characterized in that the actuable means comprises a rack means openable when the user's lips engages the actuable means and pushes on same, and said rack means causing a crimping of the liquid and air supply tubes when unactuated.

4. The valve mechanism for dispensing a liquid from claim 1 further characterized in that the user actuates the actuable means by engaging his or her lips against the actuable means and pushing on the actuable means with his or her lips and allowing the withdrawn liquid from the stem means to enter the users mouth.

5. A valve mechanism for dispensing a liquid from a generally enclosed chamber, said valve mechanism comprising:

a) a housing having a first housing section and a second housing section and where the first housing section is telescopically shiftable with respect to the second housing section;

b) a liquid delivery tube extending through said housing and having an end located in a liquid in said enclosed chamber for withdrawing the liquid and enabling dispensing of same;

c) an air supply tube extending through said housing and having an end located in said generally enclosed chamber and an end in communication with an external atmosphere to equalize pressure in the chamber when liquid is withdrawn therefrom;

d) a stem means extending through said housing and extending outwardly therefrom to be engaged by the lips of a user to withdraw liquid dispensed through the liquid delivery tube, said liquid delivery tube and air supply tube having portions which extend through said stem means; and e) rack means existing between said stem means and said second housing section and causing the liquid delivery tube to open when the lips of the user pushes against the first housing section telescopically collapsing the housing and causing a blocking of the liquid delivery tube when the user releases the pushing action on the first housing section.

6. The valve mechanism for dispensing a liquid of claim 5 further characterized in that said rack means also causes a blocking of the air supply tube when the first housing section is not pushed against and an opening of the air supply tube when the first housing section is pushed against.

7. The valve mechanism for dispensing a liquid of claim 6 further characterized in that said mechanism comprises a crimping means operable by the rack means when the user's lips engages the first housing section and pushes on same, and said crimping means causing a crimping of the liquid and air supply tubes when actuated.

8. The valve mechanism for dispensing a liquid of claim 6 further characterized in the rack means includes a rack segment on the stem means and which is engagable with gear means on said second housing section for causing operation of the crimping means.

9. The valve mechanism for dispensing a liquid of claim 8 further characterized in that a restrictor crimping member is associated with the crimping means and crimps the liquid delivery tube and air supply tube when the first housing section is extended but releases the tube when the user pushes against the first housing section.

10. A valve mechanism for dispensing a liquid from a generally enclosed chamber, said valve mechanism comprising:

a) a supporting frame;

b) a liquid delivery tube extending from said supporting frame and having an end located in the liquid for withdrawing the liquid and enabling dispensing of same;

c) an air supply tube extending from said frame and having an end located in said generally enclosed chamber and an end in communication with an external atmosphere to equalize pressure in the chamber when liquid is withdrawn therefrom;

d) a stem means associated with said frame and extending outwardly therefrom to be engaged by a user to withdraw liquid dispensed through the liquid delivery tube; and e) actuable means comprising a rack means associated with the stem means which crimps and thereby causes a blocking of the liquid delivery tube and crimps and thereby causes a blocking of the air supply tube when the actuable means is unactuated, but causing an opening of the liquid delivery tube and an opening of the air supply tube when the actuable means is engaged by a user and pushed against to be actuated and thereby enabling a withdrawal of liquid, said actuable means being operable and causing the tubes to be openable when the actuable means is engaged by the user's lips and the user pushes on same.

11. The valve mechanism for dispensing a liquid of claim 10 further characterized in that the stem means projects outwardly from the actuable means when the latter is pushed on by the lips of a user.

12. The valve mechanism for dispensing a liquid of claim 11 further characterized in that the stem means includes a rack segment and which is engagable with gear means on said supporting frame for causing operation of the rack means.

13. The valve mechanism for dispensing a liquid of claim 12 further characterized in that a restrictor crimping member is associated with the stem means and crimps the liquid delivery tube and air supply tubes when the actuable means is extended but releases the tube when the user pushes against the actuable means.

14. The valve mechanism for dispensing a liquid of claim 10 further characterized in that the user actuates the actuable means by engaging his or her lips against the actuable means and pushing on the actuable means with his or her lips and allowing the withdrawn liquid from the stem means to enter the user's mouth.

15. A valve mechanism for dispensing a liquid from a generally enclosed chamber, said valve mechanism comprising:

a) a housing having a first housing section and a second housing section and where the first housing section is telescopically shiftable with respect to the second housing section;

b) a liquid delivery tube extending through said housing and having an end located in a liquid in an enclosed chamber in said housing for withdrawing the liquid and enabling dispensing of same;

c) an air supply tube extending through said housing and having an end located in said generally enclosed chamber and an end in communication with an external atmosphere to equalize pressure in the chamber when liquid is withdrawn therefrom;

d) a stem means extending through said housing and being reciprocally shiftable through said first and second housing sections and extending outwardly therefrom to be engaged by the lips of a user to withdraw liquid dispensed through the liquid delivery tube, said liquid delivery tube having a portion which extends through said stem means; and e) actuating means associated with said stem means and said second housing section and causing an opening and closing of the liquid delivery tube and an outward reciprocally extendable movement of the stem means to open when the lips of the user pushes against the first housing section telescopically collapsing the housing.

16. A novel toy-dispensing device for child users capable of being used as a toy and also for dispensing beverage contained therein, said device comprising:

a) an outer housing having an interior beverage compartment;

b) a valve mechanism having a valve casing located within said outer housing;

c) a liquid delivery tube extending through said valve casing and having an end located in the beverage compartment for withdrawing the beverage and enabling dispensing of same;

d) an air supply tube extending through said valve casing and having an end located in said beverage compartment and an end in communication with an external atmosphere to equalize pressure in the compartment when beverage is withdrawn therefrom;

e) a reciprocally shiftable stem means associated with said valve casing and extending outwardly therefrom, said liquid delivery tube extending through said stem means such that an end of the stem means can be engaged by the lips of a user to withdraw a beverage dispensed through the liquid delivery tube, said liquid delivery tube extending through the stem means; and f) actuable means associated with the stem means and being actuated when the stem means is reciprocally shifted thereby causing a blocking of the liquid delivery tube when the actuable means is unactuated but causing an opening of the liquid delivery tube when the actuable means is engaged by the lips of a user and pushed against to be actuated and thereby enable a withdrawal of a beverage.

17. The novel toy-beverage dispensing device of claim 16 further characterized in that said actuable means also causes a blocking of the air supply tube when the actuable means is unactuated and an opening of the air supply tube when the actuable means is actuated.

18. The novel toy-beverage dispensing device of claim 17 further characterized in that the actuable means comprises a rack means operable when the user's lips engages the actuable means and pushes on same, and said rack means causing a crimping of the liquid and air supply tube when unactuated.

19. The novel toy-beverage dispensing device of claim 18 further characterized in that the stem projects outwardly from the actuable means when the latter is pushed on by the lips of a user.

20. The novel toy-beverage dispensing device of claim 19 further characterized in that a restrictor crimping member is associated with the stem means and crimps the liquid delivery tube and air supply tube when the actuable means is extended but releases the tube when the lips of a user pushes against the actuable means.

* * * * *